US006682238B2

(12) United States Patent
Yraceburu et al.

(10) Patent No.: US 6,682,238 B2
(45) **Date of Patent: *Jan. 27, 2004**

(54) CONTROLLING VACUUM FLOW FOR INK-JET HARD COPY APPARATUS

(75) Inventors: Robert M Yraceburu, Circle Camas, WA (US); James O Beehler, Circle Brush Prairie, WA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/821,406

(22) Filed: Mar. 29, 2001

(65) Prior Publication Data

US 2002/0060408 A1 May 23, 2002

Related U.S. Application Data

(63) Continuation of application No. 09/550,854, filed on Apr. 17, 2000, now Pat. No. 6,254,092.

(51) Int. Cl.[7] ..... B41J 13/02
(52) U.S. Cl. ..... 400/635; 271/276
(58) Field of Search ..... 400/635, 648, 400/578, 624, 629; 271/276

(56) References Cited

U.S. PATENT DOCUMENTS 4,207,579 A * 6/1980 Gamblin et al. ..... 271/197
5,197,812 A * 3/1993 Worley et al. ..... 198/811
6,328,440 B1 * 12/2001 Medin et al. ..... 347/102
6,336,722 B1 * 1/2002 Wotton et al. ..... 347/102
6,416,176 B1 * 7/2002 Yasui et al. ..... 347/104

FOREIGN PATENT DOCUMENTS

JP 56101885 A * 8/1981 ..... B41J/15/04
JP 05105260 A * 4/1993 ..... B65H/5/02
JP 06055731 A * 3/1994 ..... B41J/2/01
JP 10315551 A * 12/1998 ..... B41J/11/02
JP 11334943 A * 12/1999 ..... B65H/9/16
JP 2000062259 A * 2/2000 ..... G06F/12/00

OTHER PUBLICATIONS

Machine translation of JP 10315551 A from Japanese Patent Office website.*

Machine translation of JP 11334943 A from Japanese Patent Office website.*

Machine tranlsation of JP 05–105260 from Japanese Patent Office website.*

* cited by examiner

*Primary Examiner*—Daniel J. Colilla

(57) ABSTRACT

An ink-jet apparatus is disclosed having a vacuum type print media transport subsystem for moving the print media through a printing zone. A transport belt is provided with an array of perforations such that vacuum flow is restricted. The perforations only pass vacuum induced airflow through the belt when over vacuum ported platen regions.

12 Claims, 4 Drawing Sheets

"LPS"
1.25mm
2.5mm
0.3mm DIA.
501
500
2.26mm
"CBPS"
1.13mm 4.0mm
304.8mm
4.0mm
503
32
32'
500
812.8mm
503

CONTROLLING VACUUM FLOW FOR INK-JET HARD COPY APPARATUS

CROSS REFERENCE TO RELATED APPLICATIONS

This is a continuation of application Ser. No. 09/550,854 filed on Apr. 17, 2000, U.S. Pat. No. 6,254,092.

BACKGROUND OF THE INVENTION

1. Field of the Invention

The present invention relates generally to vacuum transport belt, apparatus, such as useful in ink-jet hard copy apparatus and methods of operation and, even more specifically, to a restricted flow vacuum system providing media cockle control and having minimal airflow-induced ink drop trajectory effects.

2. Description of Related Art

The art of ink-jet technology is relatively well developed. Commercial products such as computer printers, graphics plotters, copiers, and facsimile machines employ ink-jet technology for producing hard copy. The basics of this technology are disclosed, for example, in various articles in the *Hewlett-Packard Journal,* Vol. 36, No. 5 (May 1985), Vol. 39, No. 4 (August 1988), Vol. 39, No. 5 (October 1988), Vol. 43, No. 4 (August 1992), Vol. 43, No. 6 (December 1992) and Vol. 45, No. 1 (February 1994) editions. Ink-jet devices are also described by W. J. Lloyd and H. T. Taub in OUTPUT HARDCOPY [sic] DEVICES, chapter 13 (Ed. R. C. Durbeck and S. Sherr, Academic Press, San Diego, 1988). As providing background information, the foregoing documents are incorporated herein by reference. Further details of basic ink-jet printing technology are also set forth below in the Detailed Description of the present invention with respect to FIG. 1.

It is known to use a vacuum induced force to adhere a sheet of flexible material to a surface, for example, transporting sheet metal, holding a sheet of print media temporarily to a transport system or platen, and the like. Hereinafter, "vacuum induced force" is also referred to as "vacuum induced flow," "vacuum flow," or more simply as just "airflow," "vacuum" or "suction," as best fits the context. Such vacuum holddown systems are a relatively common, economical technology to implement commercially and, in printing technology, can improve hard copy apparatus throughput specifications. For example, it is known to provide a rotating drum with holes through the surface wherein a vacuum type airflow through the chamber formed by the drum cylinder provides a suction force at the holes in the drum surface (see e.g., U.S. Pat. No. 4,237,466 for a PAPER TRANSPORT SYSTEM FOR AN INK JET PRINTER (Scranton) or U.S. Pat. No. 5,081,506 for a TRANSFER SYSTEM FOR A COLOR PRINTER (Borostyan)). The term "drum" as used hereinafter is intended to be synonymous with any curvilinear implementation incorporating the present invention; while the term "platen" can be defined as a flat holding surface, in hard copy technology it is also used for curvilinear surfaces, e.g., the ubiquitous typewriter rubber roller; thus, for the purposes of the present application, "platen" is used generically for any shape paper holddown surface—stationary or movable—as used in a hard copy apparatus. Permeable belts traversing a vacuum inducing support have been similarly employed (see e.g., Scranton and U.S. patent application Ser. No. 09/163,098 by Rasmussen et al. for a BELT DRIVEN MEDIA HANDLING SYSTEM WITH FEEDBACK CONTROL FOR IMPROVING MEDIA ADVANCE ACCURACY (assigned to the common assignee of the present invention and incorporated herein by reference)).

Generally in a hard copy apparatus implementation, the vacuum device is used either to support cut-sheet print media during transport to and from a printing station (also known as the "print zone" or "printing zone") of a hard copy apparatus, to hold the sheet media at the printing station while images or alphanumeric text are formed, or both. In order to further simplify description of the technology and invention, the term "paper" is used hereinafter to refer to all types of print media and the term "printer" to refer to all types of hard copy apparatus; no limitation on the scope of the invention is intended nor should any be implied.

In essence, the ink-jet printing process involves digitized, dot-matrix manipulation of drops of ink, or other liquid colorant, ejected from a pen onto an adjacent paper. One or more ink-jet type writing instruments (also referred to in the art as an "ink-jet pen" or "print cartridge") include a printhead which generally consists of drop generator mechanisms and a number of columns of ink drop firing nozzles. Each column or selected subset of nozzles (referred to in the art as a "primitive") selectively fires ink droplets (typically each being only a few picoliters in liquid volume) that are used to create a predetermined print matrix of dots on the adjacently positioned paper as the pen is scanned across the media. A given nozzle of the printhead is used to address a given matrix column print position on the paper (referred to as a picture element, or "pixel."). Horizontal positions, matrix pixel rows, on the paper are addressed by repeatedly firing a given nozzle at matrix row print positions as the pen is scanned. Thus, a single sweep scan of the pen across the paper can print a swath of dots. The paper is stepped to permit a series of contiguous swaths. Dot matrix manipulation is used to form alphanumeric characters, graphical images, and even photographic reproductions from the ink drops. Page-wide ink-jet printheads are also contemplated and are adaptable to the present invention.

A well-known phenomenon of wet-colorant printing is "paper cockle," the irregular surface produced in paper by the saturation and drying of ink deposits on the fibrous medium. As a sheet of paper gets saturated with ink, the paper grows and buckles in a seemingly random manner. Paper printed with images are more saturated with colorant than simple text pages and thus exhibit great paper cockle. Colors formed by mixing combinations of other color ink drops form greater localized saturation areas and also exhibit greater cockle tendencies.

As the ink-jet writing instruments—often scanning at a relatively high rate across the paper-expel minute droplets of ink onto adjacently positioned print media and sophisticated, computerized, dot matrix manipulation is used to render text and form graphic images, the flight trajectory of each drop is critical to print quality. Printing errors (also referred to in the art as "artifacts") are induced or exacerbated by any airflow in the printing zone. Thus, use of a vacuum platen and vacuum transport device in the printing zone of an ink-jet printer creates an added difficulty for the system designer. One solution to the problem is set out in applicants' pending application Ser. No. 09/514,830, filed on Feb. 28, 2000, for a LOW FLOW VACUUM PLATEN FOR AN INK-JET HARD COPY APPARATUS. In essence, it employs a platen having an array of vacuum ports that are each filtered. The filter is constructed to provide restricted airflow such that media holddown pressure remains substantially uniform when the platen is either fully covered or partially uncovered. The filter mechanism provides airflow restrictions such that ink drop flight trajectories in the printing zone are unaffected, acoustic dampening of the vacuum pump is provided, and vacuum pressure is kept relatively high at the print media edges.

There is still a need for a commercial, low-cost, vacuum system for use in an ink-jet printing zone which will assist in minimizing cockle and provide a minimal airflow impact on ink-jet drop flight trajectory.

SUMMARY OF THE INVENTION

In a basic aspect, the present invention provides a vacuum platen system for transporting a sheet material, comprising: a platen having ports permitting airflow therethrough at predetermined positions of a surface thereof; a vacuum device associated with the platen and inducing the airflow; and a transport belt superjacent the surface, having an array of belt perforations such that each perforation through the belt has a diameter substantially less than the diameter the ports.

In another basic aspect, the present invention provides a method for transporting print media across a vacuum platen associated with a vacuum inducing mechanism, comprising the steps of: drawing a vacuum through a plurality of vacuum ports distributed across the platen; and transporting ink-jet print media across the platen in a predetermined direction by a perforated belt associated with the platen so as to restrict flow by a combined construct comprising the platen and the belt.

In another basic aspect, the present invention provides an ink-jet hard copy apparatus comprising: an ink-jet writing instrument associated with a printing zone within the apparatus; an endless loop vacuum belt system for transporting print media to and from the printing zone; and a vacuum platen system located proximate the printing zone, the vacuum platen system having a platen, having a plurality of vacuum ports therethrough, a vacuum chamber, and a vacuum device for maintaining a negative pressure within the chamber such that an airflow is established through the vacuum ports into the chamber, wherein the vacuum belt system has a belt having perforations, each of said perforations being of a smaller size than each of said ports such that a uniform vacuum holding pressure is exerted on a sheet of print media carried by the belt across the platen and the airflow superjacent the belt in the printing zone is less than an airflow that affects ink drop flight trajectories.

In another basic aspect, the present invention provides a vacuum flow restricting print media transport apparatus comprising: a perforated belt and ported platen combination having an effective belt porosity less than platen porosity.

In another basic aspect, the present invention provides a method for controlling airflow in an ink-jet apparatus having a vacuum transport belt for transporting ink-jet media through a printing zone, comprising the steps of: suspending the vacuum belt across a vacuum source having essentially no physical support of the belt in the printing zone; and providing appropriate flow restriction in the printing zone by controlling the areal density of perforations in the belt based on specified design parameters and intended media usage.

In another basic aspect, the present invention provides for a method for controlling airflow in an ink-jet apparatus having a vacuum transport belt for transporting ink-jet media through a printing zone, comprising the steps of: suspending the vacuum belt across a vacuum source having essentially no physical support of the belt in the printing zone; and providing appropriate flow restriction in the printing zone by controlling the areal density of perforations in the belt based on specified design parameters and intended media usage.

Some of the advantages of the present invention are:

- it provides a vacuum force sufficient for holding media in place against cockle deformation tendencies while being wetted by ink deposited thereon;
- it provides a low flow vacuum system with minimal airflow induced ink drop directionality errors;
- it provides a substantially uniform media holddown pressure when the platen is either fully covered or partially uncovered;
- it provides a low flow platen that allows vacuum box pressure to remain relatively constant whether or not paper is fully covering the platen, thus compensating for different sized print media;
- it allows for various media sizes and thicknesses to be held down with substantially the same pressure without requiring a large vacuum source;
- it reduces acoustic levels caused by a vacuum induced airflow;
- it provides a platen that is resistant to clogging by ink and paper dust;
- it provides a belt that is available for cleaning off ink and paper dust;
- it provides improved vacuum holding at paper edges;
- it reduces platen construction complexity, resulting in less piece parts and lower manufacturing costs;
- it eliminates vacuum leakage between ports;
- it provides a media transport belt construct having better heat transfer characteristics;
- it provides a media transport belt that is less subject to non-productive heat loss; and
- it provides a more durable media transport belt.

The foregoing summary and list of advantages is not intended by the inventors to be an inclusive list of all the aspects, objects, advantages and features of the present invention nor should any limitation on the scope of the invention be implied therefrom. This Summary is provided in accordance with the mandate of 37 C.F.R. 1.73 and M.P.E.P. 608.01(d) merely to apprise the public, and more especially those interested in the particular art to which the invention relates, of the nature of the invention in order to be of assistance in aiding ready understanding of the patent in future searches. Other objects, features and advantages of the present invention will become apparent upon consideration of the following explanation and the accompanying drawings, in which like reference designations represent like features throughout the drawings.

The drawings referred to in this specification should be understood as not being drawn to scale except if specifically annotated.

DESCRIPTION OF THE PREFERRED EMBODIMENT

Reference is made now in detail to a specific embodiment of the present invention, which illustrates the best mode presently contemplated by the inventors for practicing the invention. Alternative embodiments are also briefly described as applicable.

Figure 1:
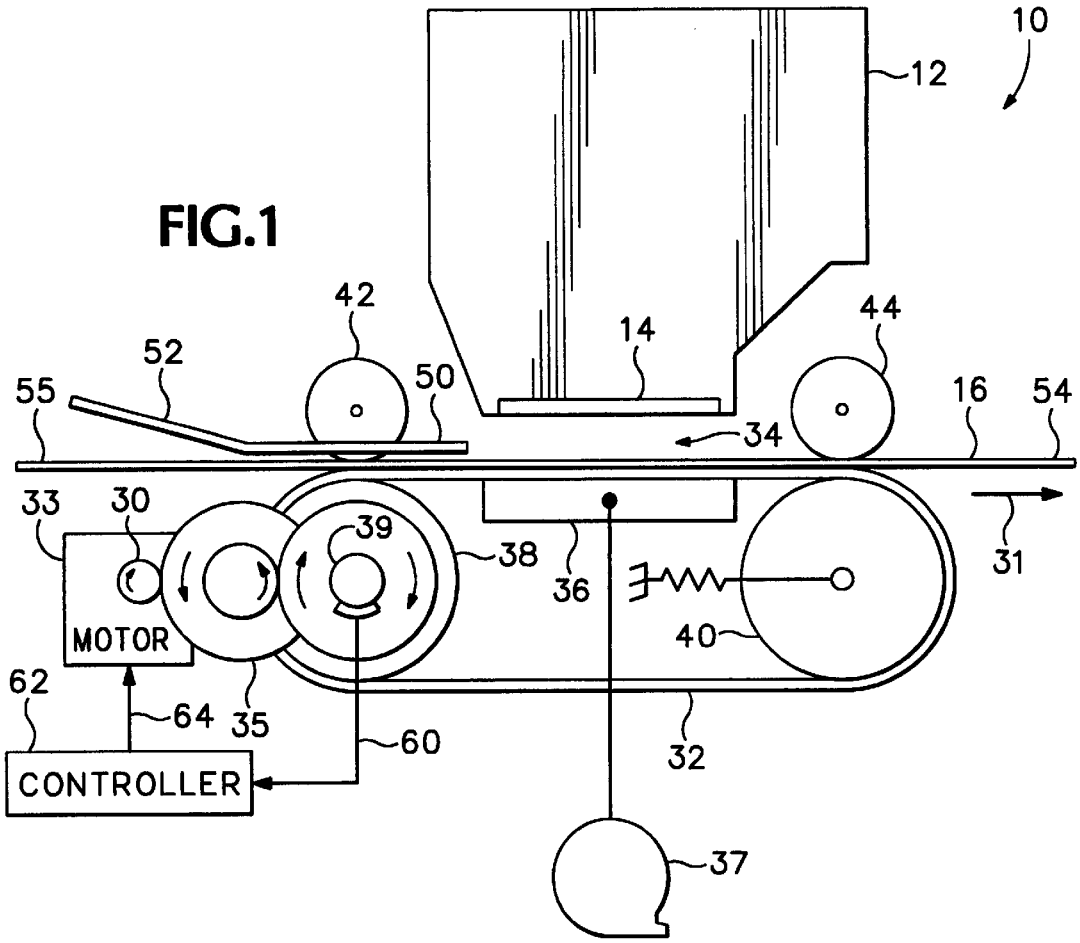
FIG. 1 is a schematic illustration of an ink-jet hard copy apparatus in accordance with the present invention.

FIG. 1 is a schematic depiction of an exemplary embodiment of an ink-jet hard copy apparatus 10 in accordance with the present invention. A writing instrument 12 is provided with a printhead 14, having drop generators including nozzles for ejecting ink droplets onto an adjacently positioned print medium, e.g., a sheet of paper 16, in the apparatus' printing zone 34.

One type of printing zone input-output paper transport, and a preferred embodiment for the present invention, is an endless-loop belt 32 subsystem. A motor 33 having a drive shaft 30 is used to drive a gear train 35 coupled to a belt pulley 38 mounted on a fixed axle 39. A biased idler wheel 40 provides appropriate tensioning of the belt 32. The belt rides over a generic platen 36 in the print zone 34; a specific platen subsystem in accordance with the present invention is described in detail hereinafter, but in general the vacuum platen subsystem is associated with a known manner vacuum induction system 37 (for simplicity of description referred to hereinafter sometimes as merely a "pump"). The paper sheet 16 is picked from an input supply (not shown) and its leading edge 54 is delivered to a guide 50, 52 aligned for delivering a leading edge to the belt; an optional pinch wheel 42 in contact with the belt 32 may be used to assist transport of the paper sheet 16 through the printing zone 34 (the paper path is represented by arrow 31). While vacuum release through the belt 32 downstream of the printing zone 34 (viz., off-platen) may be sufficient to transport the sheet 16 leading edge 54 toward the apparatus' output, an output roller 44 in contact with the belt 32 may optionally be used to receive the leading edge of the paper sheet and continue the paper transport until the trailing edge 55 of the now printed page is released.

Figure 2:
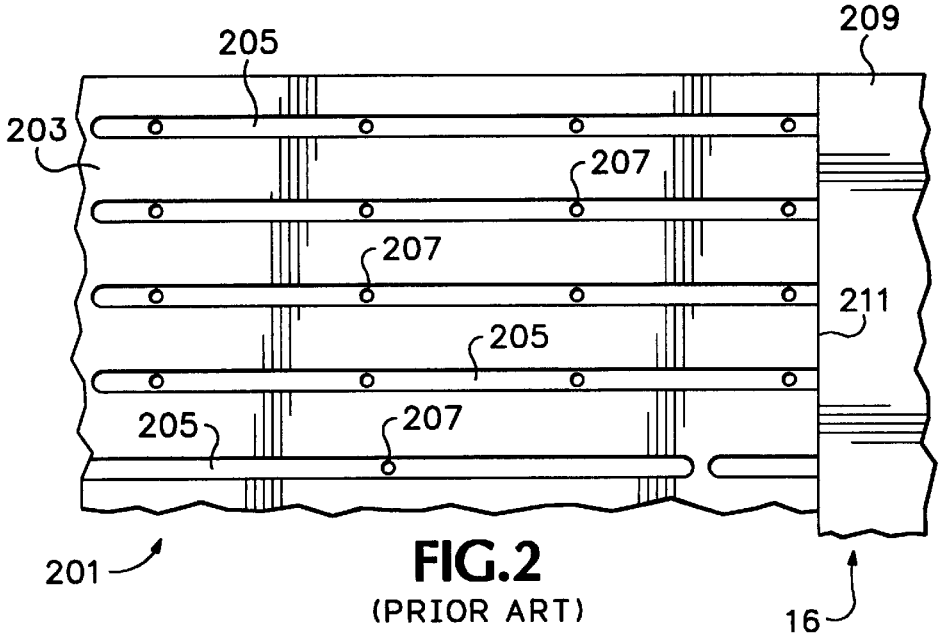
FIG.2 (PRIOR ART)
FIG. 2 (Prior Art) is a planar, overhead view of detail of the top surface of a vacuum platen.

Referring to both FIG. 1 and FIG. 2 (Prior Art), a specific type of channeled platen 201 is illustrated. This platen 201 has a top surface 203 over which the belt 32 slides. Slots 205 in the surface 203 are coupled to the subjacent vacuum induction system 37 by through-holes 207 to distribute the vacuum force across the platen 201 to hold the sheet of paper 16. A region 209 of the sheet of paper 16 is shown covering part of the surface 203 area. When a slot 205 is fully or partially open, as shown, airflow is high through the holes 207 of that slot 205 since the region 209 of paper is not closing the entire slot off from the local atmosphere. This can cause several problems. For example, the airflow into the vacuum box is high for smaller media sheets that leave a large percentage of the platen surface 203 open. This requires a relatively large vacuum pump 37. If the surface 203 is mostly open (e.g., when a 3×5-inch card is on a 12×16-inch platen such that there is only about eight percent platen coverage), the pump 37 must provide a very large flow (e.g., 200 CFM or greater) before the appropriate vacuum level (e.g., at least 6-inches $H_2O$) is produced in the slots 205 beneath the card. A large vacuum pump is undesirable since it leads to noise problems and increased cost of manufacture. The use of smaller holes 207 weakens vacuum levels in partially open slots 205 and leads to still other problems as smaller holes tend to clog with ink and paper dust. High airflow is induced around the edge 211 of the paper 209 also disturbs ink droplet flight trajectory from the pen 12 (FIG. 1 only) to the paper. Moreover, the vacuum force exerted on the underside of the paper 209 is diminished in partially open slots which might permit undesirable paper flexing, cockle, or motion during a printing cycle.

Figure 3:
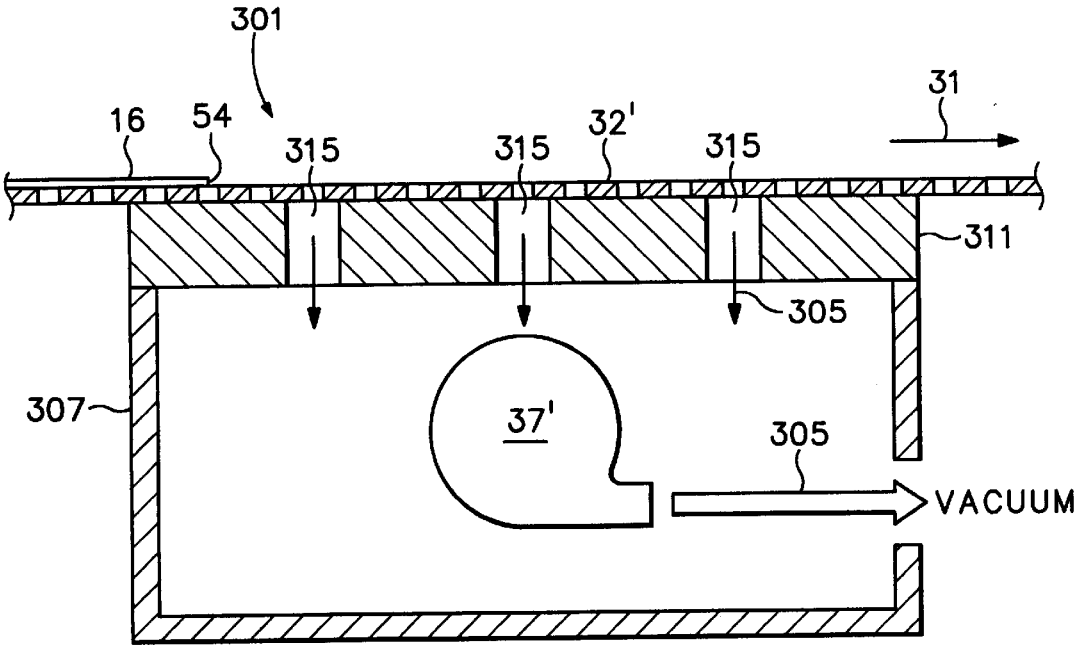
FIG. 3 is a schematic depiction of a vacuum platen system used in the present invention as also shown in FIG. 1.

Referring now to both FIGS. 1 and 3, illustrations of the details of the vacuum platen subsystem 301 for the hard copy apparatus 10 are shown. The system 301 fundamentally substitutes in the printing zone 34 of FIG. 1 for elements 36 and 37. Electrical power is supplied in any known manner; further details are not required for an understanding of the present invention.

A pump or exhaust mechanism 37' is mounted in any known manner in a vacuum box 307 (correlates in general position to FIG. 1, element 36). A sheet 16 of paper is transported along paper path 31 to the printing zone by a perforated transport belt 32'. A platen 311 member is mounted atop the vacuum box 307. The platen 311 has a plurality of vacuum passageways, or ports, 315 coupling its outer surface with the vacuum source. The vacuum flow through the platen 311 and vacuum box 307 is represented by the arrows 305. While in the shown embodiment it has been found that incorporating the pump 37' into the vacuum box 307 provides a commercially viable arrangement, it will be apparent to those skilled in the art that the vacuum pump can be remotely located in the printer 10 and coupled to the vacuum box if known manner manifolding is provided.

Figure 4:
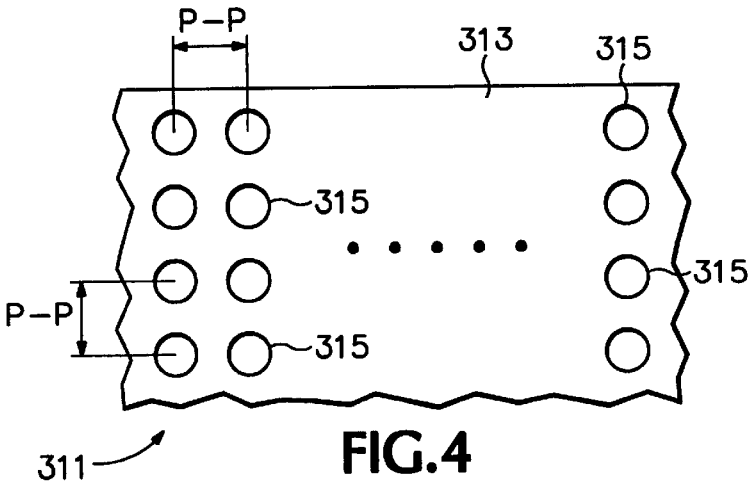
FIG.4 (PRIOR ART)
FIG. 4 (Prior Art) is an overhead view illustration of an exemplary platen surface have vacuum ports therethrough.

Turning also to FIG. 4, one embodiment of a substantially flat platen 311, has a surface 313 that has vacuum ports 315 distributed across the surface. The distribution pattern can vary depending on the design specifics of a particular implementation. In the exemplary embodiment shown, the ports 315 comprise a linear array of substantially circular apertures. In a preferred embodiment, each port has a diameter which is essentially greater than that of perforations in the belt 32 which will ride over it as shown in FIG. 1 and which are separated by a port-to-port distance, "P-P," a distance substantially greater than the distance between the perforations in the belt by a predetermined factor, generally at least double. In general, it is preferable that the platen vacuum ports 315 be large enough so that they do not clog with ink or paper dust or an aerosol mixture of the two. Ports 315 having a diameter in the approximate range of two to seven (2–7) millimeters have been found to be suitable to ink-jet printing conditions.

Figures 5, 5A:
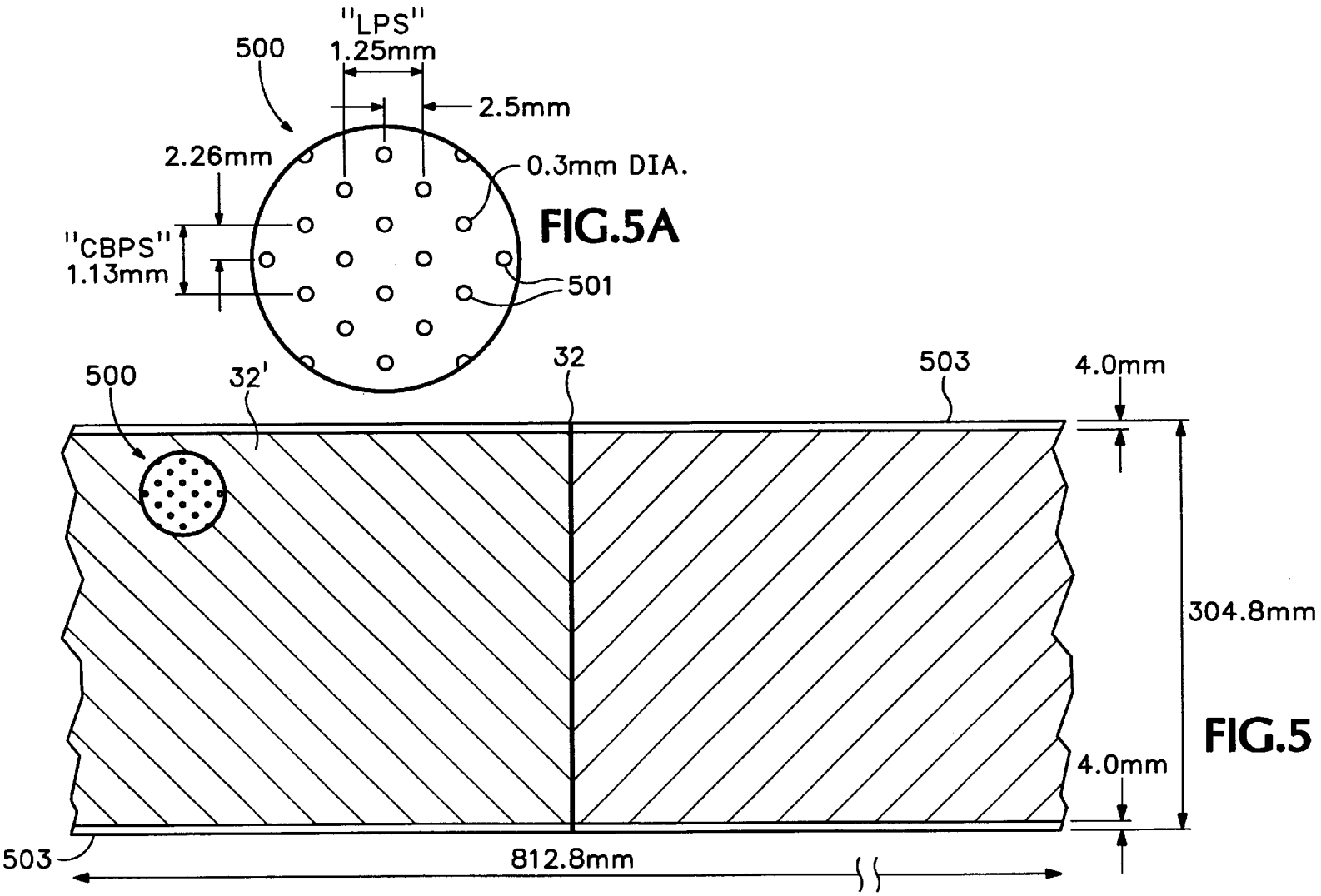
FIG. 5 is a schematic illustration (overhead view) of a section of a preferred embodiment of an endless-loop belt section in accordance with the present invention.

FIGS. 5 and 5A illustrate a preferred embodiment for a perforated metal belt 32'. Preferably, the belt 32' is fabricated of INVAR™ (commercially available from Specialty Steel and Forge company of Fairfield, N.J.), having a thickness of approximately 0.005-inch, which makes it suitably flexible for a printer 10 (FIG. 1). Other flexible metal, plastic, and fabric materials may be employed. The belt can be coated with PTFE, a nickel-PTFE blend, or any other commercial low friction substance in order to reduce drag forces and wear as the belt passes over the platen 311. A thirty-two inch endless loop by twelve inch width implementation is a preferred embodiment for use with commercially available papers up to B-size; it will be recognized by those skilled in the art that any specific implementation may vary. An array 500 of individual belt perforations 501 is provided for transmitting the vacuum 305 from the platen 311 (see FIG. 3) through the belt to its outer surface 32'.

For the platen 311 construct embodiment as shown in FIG. 4, the array 500 of perforations 501 is shown to be a staggered array and to have a crossbelt perforation separation, "CBPS," of approximately 1.13-mm and a longitudinal perforation separation "LPS" of approximately 1.25-mm. Each perforation 501 has a diameter of approximately 0.3-mm. The array 500 of perforations 501 stops at border regions 503 of the belt 32 to ensure that the integrity of the entire belt is not compromised by perforations too near the edge. In the shown embodiment, an approximate 4.0-mm wide border region 503 is provided along each longitudinal edge of the belt 32'.

With the belt perforation array 500 as shown in FIGS. 5 and 5A and the platen port construct as illustrated in FIG. 4, the perforations 501 only allow the passage of air through them when they are over platen ports 315. In other words, the design is tailored so that a sufficient flow through the belt is provided to limit wet paper positional changes and deformations yet low such that ink droplet trajectories are not affected and other problems related to the use of vacuum (see Background section above) are minimized.

It will also be recognized by those skilled in the art that in an alternative embodiment the ports may open into vacuum channels across the platen surface 313. Such an arrangement is known to provide a more uniform vacuum across the width of the platen. See e.g., U.S. patent application Ser. No. 09/292,838 by Wotton et al. for a VACUUM SURFACE FOR WET DYE HARD COPY APPARATUS (assigned to the common assignee herein and incorporated herein by reference).

Figure 6:
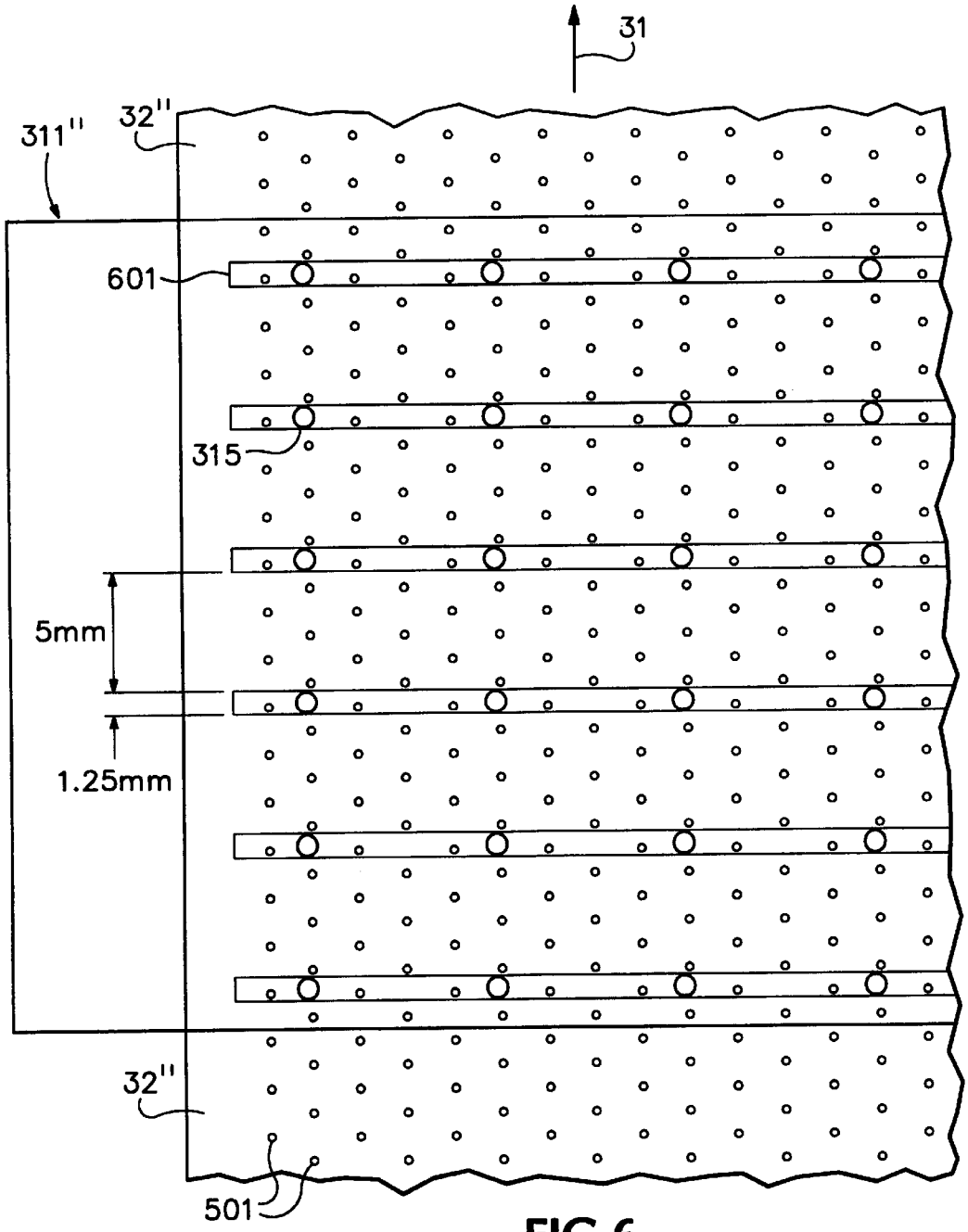
FIG. 6 is a schematic illustration (overhead view) of a section of a preferred embodiment of an endless-loop belt section (in transparency) riding over a section of a preferred embodiment of a channeled vacuum platen in accordance with the present invention for a hard copy apparatus as shown in FIG. 1.

FIG. 6 depicts a preferred embodiment combination of perforated belt 32" and platen 311' that has ported channels 601. The belt 32" section is shown as transparent so that the subjacent platen 311" details are evident. A vacuum flow rate of approximately 33 cubic feet/hour/square inch is preferred. A vacuum flow rate in the range of about 6.0 to 103 cubic feet per hour per square inch should be employed. A vacuum induction force equivalent to about 8-inches-water-column provided beneath the platen 311" is preferred. Vacuum force in the range of 3-inches-water-column to 50-inches-water-column can be employed.

A series of platen channels 601 in the platen 311", each having a depth of about 0.5-mm and width of about 1.25-mm, separated from each other by about 5.0-mm in the paper path 31 direction, are oriented to be perpendicular to the transport belt motion, paper path 31 (FIG. 1). A set of vacuum ports 315 through the floor of each channel 601 have a diameter of just slightly less than the channel width. The ports 315 within a channel 601 are separated by about 7-mm. As in FIG. 5A, a staggered array 500 of perforations 501 through the belt 32" are provided. The relative belt porosity is only about 2.5 percent. The relative platen porosity is about 20 percent. Thus, the total subsystem porosity is about one-half of one percent (0.50%). The total suited porosity is in the approximate range of twelve-hundredths to two percent (0.12% to 2.0%). The suited belt porosity is in the approximate range of twelve-hundredths to twenty percent (0.12% to 20%). The suited platen porosity is in the approximate range of ten to over ninety percent (10% to over 90%). The belt 32, 32', 32" is providing the requisite flow restriction; therefore, the platen air flow passages 315 can be relatively large and close together without having an excessively large airflow affecting drop trajectory, pump requirements, and the like as discussed in the Background section above. Larger platen holes are less likely to clog and increased packing density can provide a vacuum closer to media edges. The area of each air flow passage 315 through the platen 311, 311' should be substantially greater than the combined area of all air passages through the belt 32, 32', 32" that couple the vacuum flow 305 to the paper transport surface of the belt. If not, a significant pressure drop will occur through the platen air passages. If a platen air flow passage 315 is approximately five times as great as the associated belt holes combined area, then the pressure drop through the platen will be approximately four percent (4%) of the pressure drop through the belt. It is preferable that at least 75% of the pressure drop occurs through the belt.

In another envisioned embodiment, the vacuum belt may be suspended across a vacuum source having essentially no physical support of the belt in the printing zone, providing appropriate flow restriction there by controlling the areal density of perforations in the belt based on the specific implementation's design parameters and intended media usage. FIG. 5A provides an exemplary implementation.

Thus, the present invention provides an ink-jet apparatus 10 with a vacuum type print media transport subsystem 301 for moving the print media 16 through a printing zone 34. A transport belt 32 is provided with an array 500 of perforations 501 such that vacuum flow 305 is restricted. The perforations only pass a limited vacuum induced airflow 305 through the belt when over a platen 311 port 315.

It will be recognized by those skilled in the art that while the present invention has been illustrated in a substantially planar embodiment, the concept is applicable to curvilinear platen implementation, including vacuum drum designs where the platen and vacuum box are concentric constructs.

The foregoing description of the preferred embodiment of the present invention has been presented for purposes of illustration and description. It is not intended to be exhaustive or to limit the invention to the precise form or to exemplary embodiments disclosed. Obviously, many modifications and variations will be apparent to practitioners skilled in this art. Belt porosity and vacuum force requirements will be a function of a specific printer 10 design; actual induced vacuum force is a function of specific implementation design factors, such as sizes, shapes, thicknesses of the media, and the like as would be known to a person skilled in the art. Similarly, any process steps described might be interchangeable with other steps in order to achieve the same result. The embodiment was chosen and described in order to best explain the principles of the invention and its best mode practical application, thereby to enable others skilled in the art to understand the invention for various embodiments and with various modifications as are suited to the particular use or implementation contemplated. It is intended that the scope of the invention be defined by the claims appended hereto and their equivalents. Reference to an element in the singular is not intended to mean "one and only one" unless explicitly so stated, but rather means "one or more." Moreover, no element, component, nor method step in the present disclosure is intended to be dedicated to the public regardless of whether the element, component, or method step is explicitly recited in the following claims. No claim element herein is to be construed under the provisions of 35 U.S.C. Sec. 112, sixth paragraph, unless the element is expressly recited using the phrase "means for . . . "

What is claimed is:

1. A vacuum platen system for transporting print media through a printing zone, comprising:

an ink-jet printer platen having ports permitting airflow therethrough at predetermined positions of a surface thereof, said platen having a series of channels oriented across a direction of travel of the belt thereacross, each of said channels having at least one port coupling each of said channels to said vacuum device;

a vacuum device associated with the platen and inducing the airflow, said vacuum device including a vacuum box and a vacuum inducing device associated with the vacuum box for creating a negative pressure within the vacuum box and inducing the airflow in an approximate range of six cubic feet per hour per square inch to one-hundred cubic feet per hour per square inch; and a transport belt superjacent and in face-to-face sliding contact with the surface, having an array of belt perforations such that the perforations through the belt carry substantially only said airflow and have a diameter less than associated port diameters.

2. A vacuum platen system for transporting print media through a printing zone, comprising:

an ink-jet printer platen having channels and ports permitting airflow therethrough at predetermined positions of a surface thereof;

a vacuum device associated with the platen and inducing the airflow; and a transport belt superjacent the surface, having an array of belt perforations such that the perforations through the belt have a diameter less than associated port diameters, said channels having a cross-dimension in the direction of travel of the belt thereacross that is less than or equal to a distance separating the belt perforations in the direction of travel of the belt.

3. The system as set forth in claim 2, comprising:

the belt perforations are arranged in the direction of travel as an alternatively staggered row and column linear array of substantially circular apertures such that only alternate columns of the array are traversing the channels at a given time during passage of the belt across the platen.

4. The system as set forth in claim 3, comprising:

the array forms a pattern such that the platen surface is substantially covered by regions of said belt having no perforations therethrough such that vacuum leakage about edges of the sheet media is minimized.

5. A vacuum platen system for transporting print media through a printing zone, comprising:

an ink-jet printer platen having channels and ports permitting airflow therethrough at predetermined positions of a surface thereof;

a vacuum device associated with the platen and inducing the airflow; and a transport belt superjacent the surface, having an array of belt perforations such that the perforations through the belt have a diameter less than associated port diameters, wherein each of the vacuum ports is of a size and dimension large enough such that the ports do not clog with ink or paper dust and such that if one or more of said channels are partially open relatively low airflow is pulled through the open portion such that there is substantially no loss of vacuum pressure on sheet media edges superjacent the one or more channels.

6. A method for transporting print media across a vacuum platen associated with a vacuum inducing mechanism in a printing zone of an ink-jet hard copy apparatus, the method comprising:

drawing by said vacuum inducing mechanism an airflow through a plurality of vacuum ports distributed across the platen;

transporting ink-jet print media across the platen in a predetermined direction by a perforated belt associated by face-to-face contact relationship with the platen so as to restrict substantially only said airflow through said belt by a combined construct comprising the platen and the belt by providing a predetermined net porosity of said platen and said perforated belt in combination such that said airflow is a substantially uniform airflow established for holding an ink-jet print media on said belt; and fluidically coupling the vacuum ports to channels oriented across the platen substantially perpendicularly to the predetermined direction.

7. The method as set forth in claim 6 wherein inter-channel spacing is greater than spacing of perforations of said perforated belt.

8. An ink-jet hard copy apparatus comprising:

an ink-jet writing instrument associated with a printing zone within the apparatus;

an endless loop vacuum belt system for transporting print media to and from the printing zone; and a vacuum platen system located proximate the printing zone, the vacuum platen system having a platen, having a plurality of vacuum ports therethrough, a vacuum chamber, and a vacuum device for maintaining a negative pressure within the chamber such that an airflow is established through the vacuum ports into the chamber, wherein the vacuum belt system has a belt having perforations, each of said perforations being of a smaller size than each of said ports such that a uniform vacuum holding pressure is exerted on a sheet of print media carried by the belt across the platen and the airflow superjacent the belt in the printing zone is less than an airflow that affects ink drop flight trajectories while a substantially uniform airflow is established for holding an ink-jet print media on said belt, wherein a pressure drop through the platen is approximately four percent of a pressure drop through the belt.

9. An ink-jet hard copy apparatus comprising:

an ink-jet writing instrument associated with a printing zone within the apparatus;

an endless loop vacuum belt system for transporting print media to and from the printing zone; and a vacuum platen system located proximate the printing zone, the vacuum platen system having a platen, having a plurality of vacuum ports therethrough, a vacuum chamber, and a vacuum device for maintaining a negative pressure within the chamber such that an airflow is established through the vacuum ports into the chamber, wherein the vacuum belt system has a belt having perforations, each of said perforations being of a smaller size than each of said ports such that a uniform vacuum holding pressure is exerted on a sheet of print media carried by the belt across the platen and the airflow superjacent the belt in the printing zone is less than an airflow that affects ink drop flight trajectories while a substantially uniform airflow is established for holding an ink-jet print media on said belt, wherein cross-sectional diameter of each of said ports is approximately five times cross-sectional diameter of each of said perforations.

10. A vacuum flow restricting print media transport apparatus comprising:

a perforated belt and ported platen combination having an effective belt total porosity less than platen porosity and having a sliding contact relation, at least seventy-five percent (75%) of a pressure drop in the apparatus occurring through the perforated belt by way of said effective belt total porosity being less than said platen porosity.

11. An ink-jet hard copy apparatus print media transport belt for use with a vacuum platen having a plurality of vacuum ports, each port having a port cross-sectional area, the apparatus comprising:

an endless loop metal belt, and an array of perforations through the metal belt, each of which is configured to have a perforation cross-sectional area less than said port cross-sectional area, providing a predetermined net porosity of said platen and said perforated belt in combination such that a substantially uniform airflow is established for holding an ink-jet print media on said belt, wherein a ratio of perforation cross-sectional area to port cross-sectional area is approximately 1:5.

12. An ink-jet hard copy apparatus print media transport belt for use with a vacuum platen having a plurality of vacuum ports carrying an airflow, each port having a port cross-sectional area, the apparatus comprising:

an endless loop metal belt in face-to-face sliding contact with said platen, and an array of perforations through the metal belt, each of which is configured to have a perforation cross-sectional area less than said port cross-sectional area, providing a predetermined net porosity of said platen and said perforated belt in combination such that a substantially uniform airflow is established for holding an ink-jet print media on said belt, the belt perforations being arranged in the direction of travel as an alternatively staggered row and column linear array of substantially circular apertures.

* * * * *